United States Patent [19]

Chen et al.

[11] 4,358,290

[45] Nov. 9, 1982

[54] BURNING PROPERTIES OF FLUID COKE

[75] Inventors: Nai Y. Chen, Titusville, N.J.; Dennis E. Walsh, Richboro, Pa.

[73] Assignee: Mobil Oil Corporation, New York, N.Y.

[21] Appl. No.: 163,599

[22] Filed: Jun. 27, 1980

[51] Int. Cl.[3] ..... C10L 9/00; C10L 5/00

[52] U.S. Cl. ..... 44/1 F; 44/23; 44/24; 201/23; 208/127

[58] Field of Search ..... 44/1 F, 1 B, 1 R, 10 C, 44/23, 24; 201/23; 208/50, 127

[56] References Cited

U.S. PATENT DOCUMENTS

| | | | |
|---|---|---|---|
| 1,529,706 | 3/1925 | Merz | 44/1 F |
| 1,598,086 | 8/1926 | Kitchen | 44/1 R |
| 1,618,669 | 2/1927 | Morrell | 44/1 R |
| 2,725,349 | 11/1955 | Cahn et al. | 208/64 X |
| 2,838,386 | 6/1958 | Mason | 44/24 |
| 2,894,899 | 7/1959 | Crawley | 208/127 |

*Primary Examiner*—Carl F. Dees

*Attorney, Agent, or Firm*—Charles A. Huggett; Michael G. Gilman; Charles J. Speciale

[57] ABSTRACT

An improved solid fuel obtained by blending fluid coke with 2 to 20 wt. % of a heavy petroleum liquid.

4 Claims, No Drawings

BURNING PROPERTIES OF FLUID COKE

BACKGROUND OF THE INVENTION

1. Field of the Invention.

This invention relates to a carbonaceous fuel produced from fluid petroleum coke and a method for its preparation.

2. Description of the Prior Art.

Fluid coke is the product of a known coking process for pyrolytically upgrading petroleum oils which utilizes the fluidized solids technique. In this process, a fluidized mass of high temperature solids, usually coke formed by the process, supplies the heat of pyrolysis. The charging stock to be upgraded is sprayed into the fluid bed and upon contact with the high temperature solids undergoes pyrolysis, evolving lighter hydrocarbon vapors and depositing carbonaceous residue, i.e., coke, on the solids. To maintain the coking temperature, a portion of the solids is continuously circulated to an external heating zone and returned to the fluidized bed of solids present in the coking zone.

The coke particles withdrawn from the coking zone are reheated by partial combustion in the heating zone. Thus the fluid coke product is the result of sequential oxidations of small increments of exterior particle surface with intermediate depositions of fresh coke. In a typical process, about 4% wt. to 7% wt., based on charge, of the gross coke produced in the coker is removed in the burning zone and about 1 to 5% by weight of the coke returned to the coker is added in each subsequent passage through the coking reaction zone.

A fraction of the circulating coke solids is withdrawn, usually on a continuous basis, as a fluid coke product, the withdrawal maintaining a substantially constant inventory of solids in the process and maintaining the desired coke particle size range. The coke produced in fluid coking systems is very hard. Because of its hardness, density, sulfur content, etc., it is not generally of a quality suitable for use in most carbon utilizing applications. It has been further asserted that the burning properties of fluid coke are inferior to those of other solid carbonaceous materials such as bituminous coal and delayed petroleum coke. Certainly, the tendency of fluid coke to have a higher sulfur content than these other carbonaceous fuels creates pollution problems during its combustion. But the less desirable burning properties of fluid coke also include its relative combustibility, i.e., the ease with which it will burn.

The following table shows a comparison of fluid coke with other solid carbonaceous fuels.

TABLE I

| | Petroleum Fluid Coke | Delayed Petroleum Coke | Low-Volatile Bituminous Coal (1) | Sub-bituminous Coal (2) |
|---|---|---|---|---|
| Volatile (wt. %) | 3.7–7.0 | 8–18 | 18.2 | 33.3 |
| Ash (wt. %) | 0.05–1.6 | 0.1–2.8 | 3.9 | 3.8 |
| Heating Value (BTU/lb.) | 13,900–14,400 | | 14,550 | 9,420 |
| H (wt. %) | 1.6–2.1 | | 4.8 | 6.4 |
| C (wt. %) | 88–95 | | 84.0 | 54.6 |
| S (wt. %) | 1.5–10 | | 0.6 | 0.4 |
| Ash-softening Temp. (°F.) | 220–2800 | | | 2060 |
| Grindability | 20–30 | 40–60 | | |

(1) West Virginia, Pocahontas No. 3
(2) Wyoming, Monarch

The ignition temperature of fluid coke is generally about 1400° F., considerably higher than coal or delayed petroleum coke (about 1150° F.). The burning rate of fluid coke, however, can be equal to or greater than that of delayed petroleum coke, indicating that, once it is ignited and ignition is maintained, fluid coke combustion may be completed in a comparable or shorter amount of time than delayed coke combustion.

Fluid coke does have potential for use as a solid fuel. However, its use in this regard is limited by the foregoing properties, especially its high ignition temperature and the difficulty of maintaining ignition in low heat capacity furnace systems such as steam boilers.

Steam generating boilers burning pulverized solid fuel are well known in the art. Pulverized fuel and air are blown into a furnace combustion chamber as a combustible mixture and ignited. The resulting solid fuel-air flames extend a material distance into the chamber, the walls of which are kept comparatively cool by heat transfer to water tubes lining the chamber (unlike relatively large heat capacity furnace systems such as kilns which retain heat and are less sensitive to temperature variations). Thus, the steam boiler combustion chamber does not "run hot" for ensuing reignition or stable combustion in the event of process fluctuations such as momentary flame die-out or instability.

Accordingly, transient conditions such as clogging of the pulverized solid fuel feeder means, pulverizer discontinuity, decreased air supply, etc., that reduce or briefly curtail the fuel or air supply tend to cause flame instability and possible flame-out, which in turn can result in furnace shutdown with loss of steam generating capacity and production time. Restarting a furnace after flame-out and shut-down is complicated by the need to clean the combustion chamber of all gases, combustion products and unburned mixtures before reignition. This not only consumes valuable production time but also results in objectionable stack emissions that tend to foul pollution control equipment.

When fluid coke is employed as the solid fuel, the foregoing problems are aggravated because of the difficulty of maintaining ignition and the consequently greater flame instability. A related problem regarding fluid coke combustion in relatively small heat capacity furnace systems, is unburned carbon loss from the furnace system.

A known technique for maintaining combustion temperatures in pulverized solid fuel burners is the use of an auxilliary fuel as an ignition accelerator. The auxilliary fuel which may be gaseous, liquid or solid is premixed with either the primary air or the pulverized solid fuel as it enters the burner nozzle. Another method is to position a pilot flame adjacent to the nozzle of the pulverized fuel burner. Auxilliary fuel is used to maintain the pilot flame which aids in maintaining the temperature of the solids sufficiently high to promote complete combustion in the combustion zone.

Again, because of the high ignition temperature of fluid coke and the temperature sensitivity of its combustion, neither of these methods entirely satisfies the problems encountered when burning fluid coke in relatively small heat capacity furnace systems. The problem is not only the maintenance of ignition temperatures at the burner itself but throughout the combustion chamber.

Accordingly, an object of the present invention is an improved fluid petroleum coke fuel. A related object is a fluid petroleum coke fuel having properties such that it is a superior fuel in relatively small heat capacity furnace systems such as steam generating boilers, especially industrial boilers. Other objects will be apparent from the following description of the present invention.

SUMMARY OF THE INVENTION

The combustibility of fluid coke is improved by blending the coke with about 2 to 20 wt. % of high-boiling petroleum liquids such as residual oils. Desirably, the blending liquid is a portion of the heavy hydrocarbon feed to the fluid coker producing the fluid coke product. Because the amount of blending liquid required is small compared to the gas and liquid yields of the fluid coking process, production of heavy oil/coke blends solves the combustibility problems associated with coke produced by the conventional fluid coking process while maintaining the high liquid yield of the fluid coking process as compared to that from the delayed coking process. The blended fuel product is an excellent replacement for the fuel of coal- or delayed coke-burning furnaces.

DETAILED DESCRIPTION OF THE INVENTION

Experiments were performed to check the combustibility of fluid coke vs. delayed coker needle coke and delayed coker sponge coke. The cokes were calcined in nitrogen, and, in the case of delayed coke samples, a brief air exposure at 600° C. was sometimes employed to effect a mild surface area enhancement. Calcination removed heavy oil "volatiles" from the delayed coke sample (~2-5 wt. %) so that the results of combustion experiments compare "dry" delayed coke with "dry" fluid coke. Runs were conducted between ~500° C.-600° C. in a manner which would minimize or eliminate mass transfer influences and the kinetic results were well described by a first order rate constant over ~85% of the burn-off. Results indicate that over the range of conditions investigated both the "dry" fluid coke and the "dry" delayed coke burn at similar rates.

Based upon these results, it was concluded that any major differences between the combustibility of fluid coke and delayed coke under practical industrial conditions must be due to the presence of the heavy oils in the delayed coke which would tend to be more readily oxidized than the delayed coke itself and thus would aid in initiating and stabilizing the coke combustion process.

In the instant concept the ability of these oils to aid in sustaining the combustion process is used to improve the burning characteristics of fluid coke via blending either part of the coker feed or other heavy petroleum oils with the "dry" product coke to produce a "wet" coke having 2 to 20% of volatiles. The resultant fluid coke will then be suitable for use as a solid fuel in applications which typically use coal and/or delayed coke.

In light of the increasing role of heavy crude oils in supplying energy needs, the attractiveness of fluid coking relative to delayed coking is substantial. However, the relative attractiveness of fluid coker yields is tempered by the relative unattractiveness of the coke byproduct. The present invention enhances the attractiveness of the fluid coke byproduct to produce a solid fuel product which is at least the equal of its delayed coker counterpart. The yield comparison shown in the following table for a residuum charge with a CCR of 13.5 demonstrates an important advantage of the present invention.

TABLE II

| Process | Products | #/100# of resid feed |
|---|---|---|
| Conventional Delayed Coking | Gas | 10 |
| | Liquid | 65 |
| | Coke (1) | 25 |
| Conventional Fluid Coking | Gas | 9 |
| | Liquid | 76 |
| | Coke (2) | 10 |
| Improved Fluid Coking (3) | Gas | 9 |
| | Liquid | 74 |
| | Coke (2) | 10 |
| | Blended Coke Product | 12 |

(1) Coke contains ~9% volatiles.
(2) Note that 5# of coke/100# of resid feed is consumed to provide process heat. The figure shown is net coke make. Coke contains only ~2% wt. volatiles.
(2) In this example of the present invention, 2# of resid/100# of resid feed is blended with the coke product to produce a blended coke product containing about 17% volatiles.

When compared with a conventional delayed coking process, the improved fluid coking process using the concept of this invention produces 14% more, valuable liquid product *and* a superior solid fuel product. When compared with a conventional fluid coking process, the improved fluid coking process using the concept of this invention produces a superior solid fuel product with less than 3% yield loss of liquid product.

The fluid coke component of the solid fuel of this invention may be any coke byproduct of a fluid coking process. However, the invention is most suitably applied to fluid coke having a volatile content (proximate analysis) of less than 8% and preferably less than 4%.

In a preferred embodiment of this invention, the heavy oil blended with fluid coke is a portion of the charge to the fluid coker itself. Generally, the heavy oil may be any petroleum liquid boiling above about 650° F. and preferably above about 900° F. Examples of such high-boiling petroleum liquids are atmospheric and vacuum distillation residues, FCC main column bottoms and the like. The API gravity of the blending oil should be less than about 15.

The amount of heavy oil blended with the fluid coke is broadly within the range from about 2 to 20 wt. % (based on the fluid coke). The upper limit of the heavy oil:coke ratio is the amount of oil which results in a sticky mass. A "flowing solid" is necessary to achieve furnace operability. The lower limit of the ratio is related to the quantity of volatiles necessary to support combustion, the quantity of volatiles necessary to avoid "flame-out" in the furnace combustion chamber. Preferably, about 7.5 to 15 wt. % of heavy oil (based on the fluid coke) is added.

The heavy oil should be distributed as homogenously as possible through the solid, fluid coke material. The method of blending the heavy oil and coke may therefore comprise rapid immersion of solids in the warm oil. Alternatively, the heavy oil may be provided in a vehicle liquid, which may be organic or aqueous in nature and which will readily be recovered via evaporation leaving the heavy oil behind in intimate contact with the coke.

While not wishing to be bound by any particular theory of operability, it is believed that a principal advantage of the solid fuel product of this invention is the ease, relative to conventional dry fluid coke alone, with which the individual coke particles may be maintained at or above ignition temperature in the combustion chamber of relatively small heat capacity furnace systems, enabling a more efficient and complete combustion of the solid fuel therein. While the heavy oil component of the oil/coke mixture will also aid in initially bringing the coke component up to ignition temperature, the use of an auxilliary fuel for this purpose may also be necessary or desirable. In particular, an auxilliary gas fuel will serve advantageously to initially ignite the fuel mixture of this invention. Because of the faster combustion rate of the auxilliary gas fuel, it would not sustain the combustion of fluid coke alone, this function being served by the heavy oil component of the solid fuel product of this invention.

What is claimed is:

1. A particulate solid fuel having an ignition temperature that maintains ignition of said fuel when utilized in the furnace combustion chamber of a steam generating boiler burning pulverized solid fuels, said particulate solid fuel being a flowing solid and being produced by blending fluid petroleum coke with heavy oil in an amount varying from about 2 to 20 percent by weight of coke, said coke having a volatility content of less than 8 percent by weight and said heavy oil being a petroleum liquid boiling above about 900° F. selected from the group consisting of atmospheric or vacuum distillation residues, FCC main column bottoms, and the like, and having an API gravity of less than about 15, said heavy oil and said coke being at a heavy oil:coke ratio having an upper limit that is defined by the amount of heavy oil which results in a sticky mass and a lower limit that is defined by the quantity of volatiles necessary to support combustion and the quantity of volatiles necessary to avoid "flame-out" in said furnace combustion chamber.

2. The particulate solid fuel of claim 1 wherein the heavy oil is a portion of the charge to the fluid coker producing the fluid petroleum coke.

3. A method of producing the composition of claim 1 which comprises blending said fluid petroleum coke with said heavy oil in an amount ranging from about 2 to 20 percent by weight of coke.

4. In a hydrocarbon oil fluid coking process wherein an oil is pyrolytically converted in a coking zone by contact with fluidized particulate coke maintained at a coking temperature to gaseous and liquid conversion products and carbonaceous residue which is deposited on said solids, a portion of which solids and carbonaceous residue is at least periodically recovered as a fluid coke product, the improvement which converts said fluid coke product to a flowing solid fuel having a combustibility at least equal to the combustibility of delayed coke when said solid fuel is utilized in a steam generating boiler burning pulverized solid fuels, said improvement comprising the step of blending said fluid coke product with a protion of said hydrocarbon oil in an amount ranging from about 2 to 20 percent by weight of the coke product, said coke having a volatility content of less than 8 percent by weight and said heavy oil being a petroleum liquid boiling above about 900° F. selected from the group consisting of atmospheric or vacuum distillation residues, FCC main column bottoms, and the like, and having an API gravity of less than about 15.

* * * * *